United States Patent [19]

Govan

[11] Patent Number: 4,834,683

[45] Date of Patent: May 30, 1989

[54] APPARATUS FOR REDUCING EXHAUST GAS PRESSURE IN OUTBOARD AND INBOARD/OUTBOARD MOTORS

[76] Inventor: Donald T. Govan, P.O. Box 350246, Fort Lauderdale, Fla. 33335

[21] Appl. No.: 34,836

[22] Filed: Apr. 3, 1987

[51] Int. Cl.[4] ..... B63H 1/16

[52] U.S. Cl. ..... 440/89; 416/93 A; 416/245 A; 440/49

[58] Field of Search ..... 440/89, 49, 900; 416/93 A, 146 B, 146 R, 245 A

[56] References Cited

U.S. PATENT DOCUMENTS 2,213,609 9/1940 Ronning ..... 440/89

4,212,586 7/1980 Aguiar ..... 416/93 A

*Primary Examiner*—Joseph F. Peters, Jr.

*Assistant Examiner*—Edwin L. Swinehart

*Attorney, Agent, or Firm*—Malin, Haley & McHale

[57] ABSTRACT

A device for increasing the efficiency of operation of an internal combustion engine used in outboard and inboard/outboard motors comprised of a generally cylindrical member having inner and outer peripheral shell members defining a cylindrical annular space therebetween, wherein are located a plurality of turbine vanes spanning the annular volume between said inner and outer shell members. Said inner and outer shell members and said plurality of vanes are drivingly connected to the propeller shaft of an outboard motor and are mounted coaxially with said propeller shaft. The device is located in the forward end of the inner propeller hub and rotatably mounted in association with the lower unit of said outboard or inboard/outboard motor so that exhaust gases flowing through said lower unit pass through said annular volume. Upon rotation of said propeller shaft, said plurality of vanes are caused to rotate at the same angular velocity thereof. Said vanes are configured in such a way so that the exhaust gases are caused to be moved through said lower unit at an elevated velocity thereby causing a decrease in pressure between the lower unit and the exhaust port of the combustion chambers. Exhaust gases are thereafter expelled from the rear of the propeller unit. The decrease in pressure at the exhaust ports causes the engine operation to be more efficient due to the decrease in work required by the piston or pistons to expel exhaust gases therefrom.

5 Claims, 3 Drawing Sheets

86
22''
23
P
22'
22
16
FLOW 65
81
69
58
60
69
60
60
22
22
36
32
30
30
26
18
16
16
12
14
86
22''
23
P
16
22'
22
FLOW

APPARATUS FOR REDUCING EXHAUST GAS PRESSURE IN OUTBOARD AND INBOARD/OUTBOARD MOTORS

BACKGROUND OF THE INVENTION

The instant invention relates to a device for increasing the efficiency of operation of an internal combustion engine. More particularly, this invention relates to a device having a turbine-like blade structure for increasing flow of exhaust gases after exiting the exhaust ports of an internal combustion engine.

It is well known that a major contributing factor to the decreased efficiency of internal combustion engines is the pressure of the exhaust gases working against the pistons during the exhaust stroke in a four stroke engine, and during the exhaust phase of a two-stroke engine. It would therefore be desirable to reduce the pressure of the exhaust gases so that the pistons in either engine can operate under less restriction. This would then allow the engine to operate at increased speed with a given input of energy thus increasing the overall operational efficiency thereof.

One embodiment of the instant invention is an improvement over the device disclosed in applicant's co-pending application Ser. No. 907,195, filed Sept. 12, 1986, entitled "Line Cutter for Outboard, Inboard/Outboard, and Trolling Motors". Saidapplication is incorporated herein by reference. The line cutter of said device is comprised of a plurality of sharp rotating blades which rotate in closely spaced relation to a fixed sharp blade. The inclusion of said rotating blades sharply decreases the power output of the marine motor due to hydrodynamic drag and increased back pressure caused by the cutter apparatus. The instant invention, being a device to increase the efficiency of the operation of said motor, offsets the decrease in power output caused by hydrodynamic drag, an in fact increases the power output of said motor over and above the net of gain and loss.

SUMMARY OF THE INVENTION

The instant invention is comprised of a generally short cylindrical rotatable hub member having an outer peripheral shell and an inner peripheral shell concentrically spaced therefrom, said inner and outer shells defining an annular volume therebetween. Occupying a portion of said annular volume are a plurality of spaced apart turbine or airfoil-like vane members so angled as to cause gases flowing through said annular volume to be expelled at an elevated velocity from said cylindrical member when said cylindrical member is rotating. The degree of elevation of the velocity of the flowing gas is proportional to the speed of rotation of the cylindrical member, to the pitch of the vanes and to the cross-sectional shape of each vane. The vane members may be constructed in airfoil-like fashion for accelerating the exhaust gas flow.

The cylindrical member is rotatably mounted in sandwiched relation between the propeller and the lower drive unit of an outboard motor. Said cylindrical member is drivingly connected to the propeller shaft of said outboard motor and therefore rotates with said output shaft. In particular, the cylindrical member is mounted where the propeller meets the motor housing of the lower unit from which extends the propeller shaft.

The device is uniquely applicable to marine outboard and inboard/outboard motors wherein exhaust gases flow from the exhaust ports of the combustion chambers through ducting within the housing of the lower unit and are finally expelled through the aft end of the propeller hub. In this configuration, the exhaust gases flow directly through the rotating propeller hub in the axial direction. It is deemed desirous therefore to interpose said turbine-like vanes within the flow of exhaust gases to capitalize on the rotational motion of the lower unit output shaft (propeller shaft). Said vanes are sized and shaped so as to cause an increase in the velocity of the exhaust gas flowing therethrough once said cylindrical member begins rotating, thereby reducing the effect of exhaust gas pressure on the pistons during operation of the engine.

The instant invention may be used in conjunction with applicant's line cutter invention disclosed in said co-pending application Ser. No. 907,195. An alternative embodiment may be comprised of a short cylindrical member having the internal turbine-like vane members for increasing the velocity of the exhaust gas flow but lacking the cutting means of the first mentioned embodiment. In this second embodiment, the short cylindrical member is integrally and drivingly connected to the propeller of the outboard motor, as is the case where the short cylindrical member is used in conjunction with the cutting means.

It is therefore an object of the instant invention to provide a means of increasing the efficiency of the internal combustion engine in a marine outboard motor by increasing the flow of the exhaust gases after said exhaust gases have left the exhaust ports of the combustion chambers.

It is a further object of the instant invention to provide a device which utilizes the rotational energy of the propeller shaft of a marine outboard motor to increase the flow of exhaust gases from said motor to thereby decrease the pressure force exerted against the pistons.

It is a still further object of the instant invention to decrease the back pressure in the exhaust gas lines of a marine outboard motor downstream of the exhaust ports of the combustion chambers.

This invention accordingly comprises the features of construction, combination of elements and arrangement of parts that would be exemplified in the construction hereinafter set forth, and the scope of the invention will be indicated in the claims.

DETAILED DESCRIPTION OF THE PREFERRED EMBODIMENT

Figure 1:
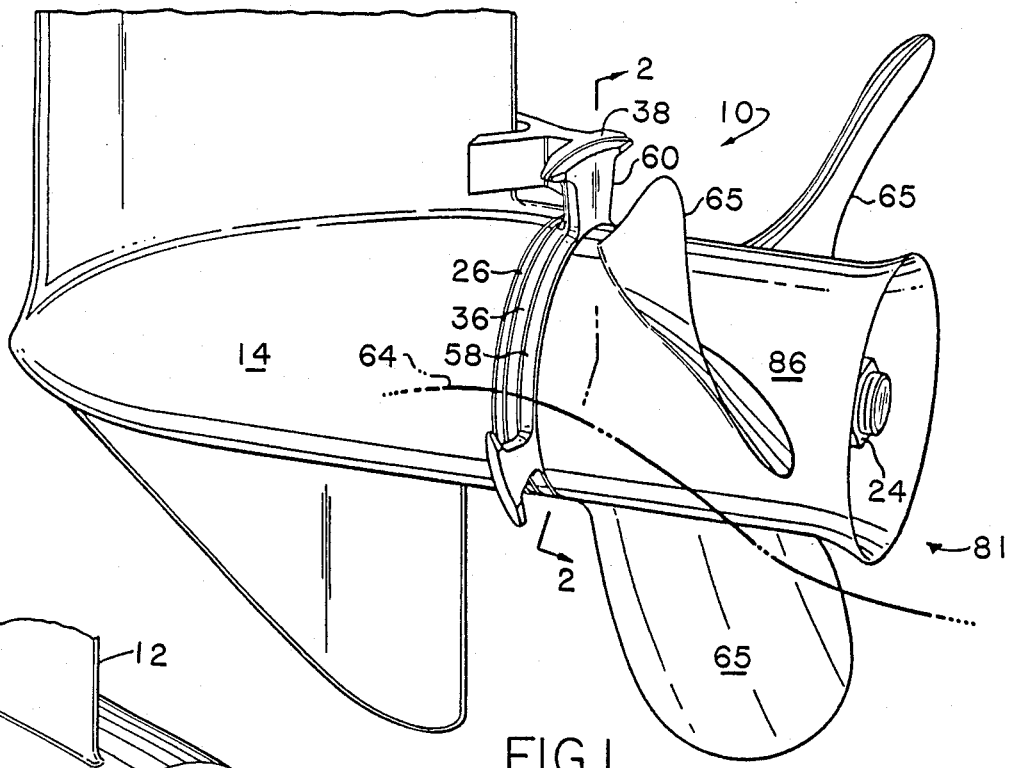
FIG. 1 is a perspective view showing the lower drive unit of a marine outboard or inboard/outboard motor and associated propeller hub, with the invention connected therebetween in conjunction with a line cutter means.

Throughout this description, the terms "forward" and "rearward" shall refer to the left and right, respectively, of all Figures. The instant invention is to an apparatus for reducing exhaust gas pressure in outbaord and inboard/outboard motors, and is designated generally be reference numeral 10. In general, the invention is positioned in the forward exhaust flange of the propeller unit 86. A first embodiment, shown in FIGS. 4 and 5, is comprised of a generally short cylindrical rotatable impeller hub member 20 comprised of an inner cylindrical member 23 connected to an outer coaxial cylindrical member 21 by a series of air foil-like vanes 22 which cause the outboard motor exhaust gases to be accelerated therethrough when said hub member 20 rotates with propeller unit 81.

Figures 2A, 3, 4A:
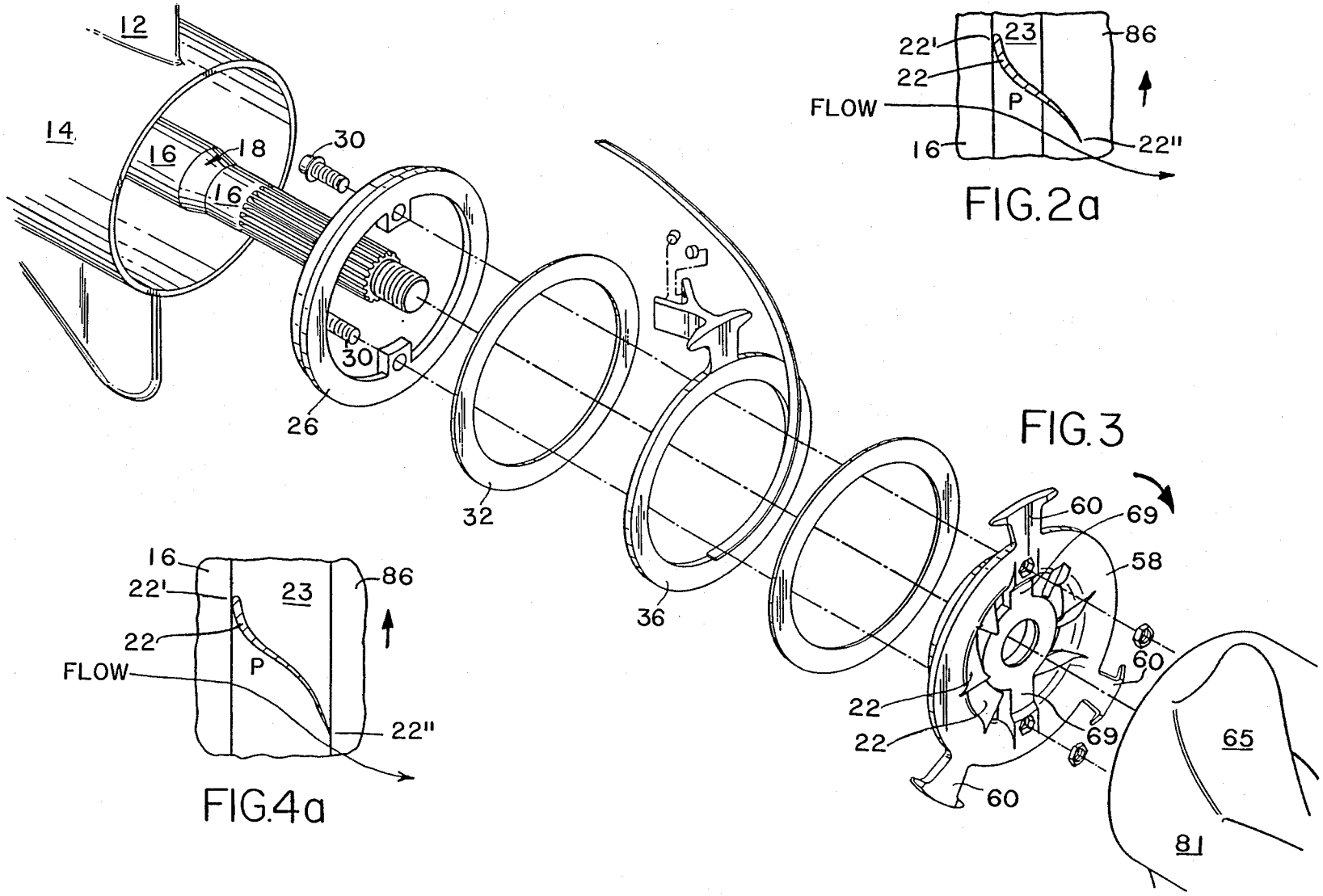
FIG. 2A is a sectional view taken along line 2A—2A of FIG. 2.
FIG. 3 is an exploded view showing the invention in position for connection to a marine outboard motor.
FIG. 4A is a sectional view taken along ilne 4A—4A of FIG. 4.
Figure 2:
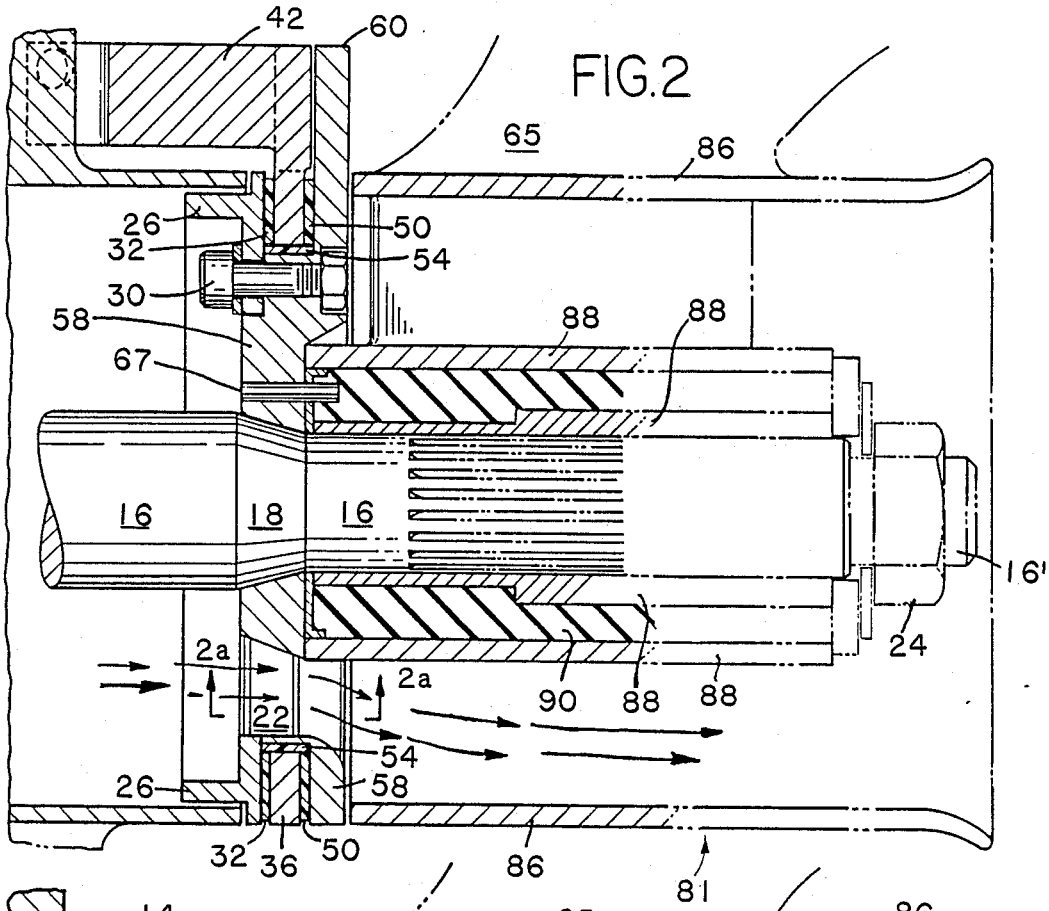
FIG. 2 is a sectional view taken along line 2—2 of FIG. 1.

In an alternative or second embodiment, best seen in FIGS. 1, 2 and 3, air foil-like vanes 22 may be connected to the cutter ring 58 of the invention disclosed in Applicant's above-referenced U.S. patent application Ser. No. 907,195. The invention is particularly useful in conncection with the line cutter device as an aid to engine performance to compensate for the decrease in power output brought on by the drag and inertial losses caused by the line cutter blades, which rotate with the propeller.

A third embodiment may be realized by, in the alternative, placing said vanes 22 in connection with bolt ring 26 of the above referenced U.S. patent application. In all three embodiments, the aerodynamic feature of the air foil-like vanes 22 causes an increase in the flow velocity of the exhaust gas escaping through the housing of the lower drive unit 14.

Figure 5:
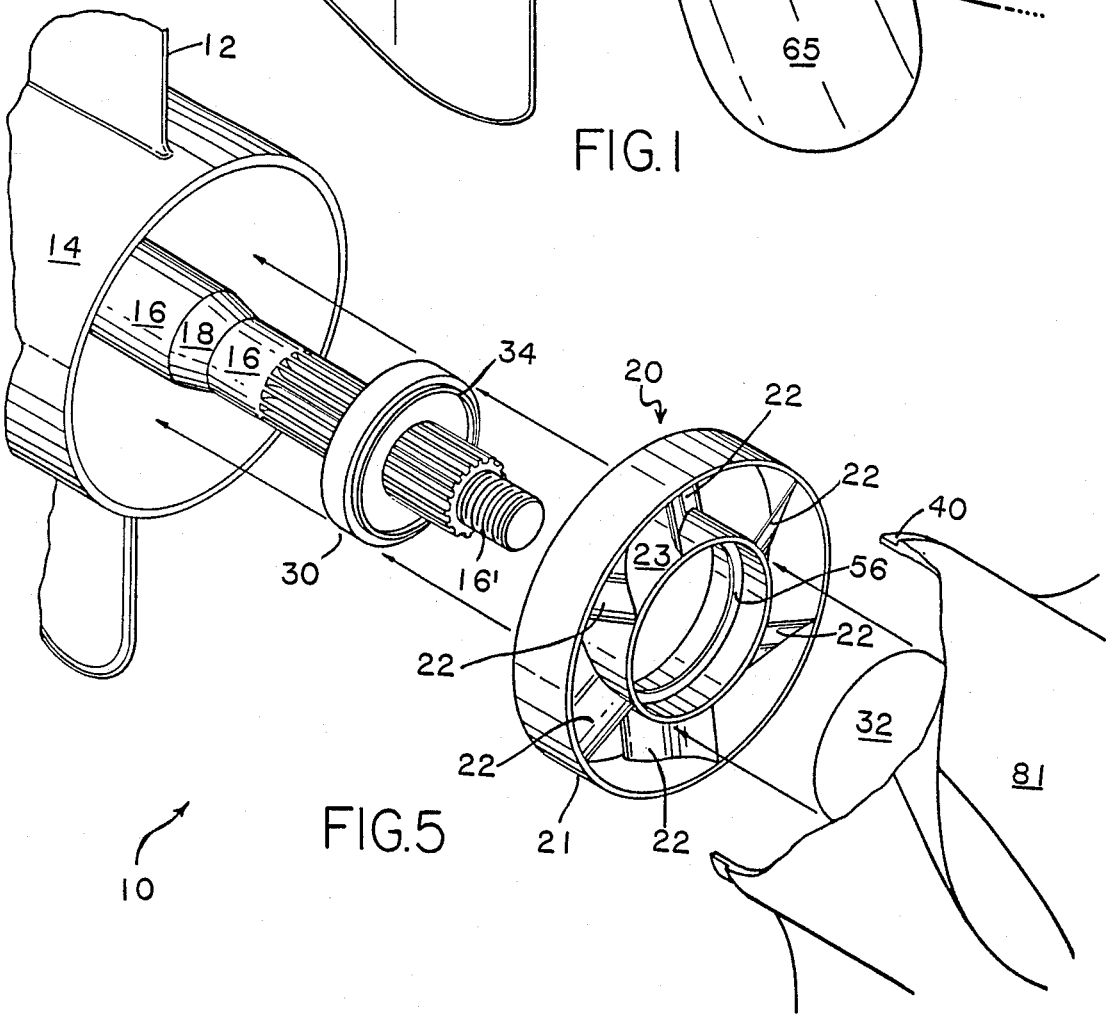
FIG. 5 is an exploded view of the invention of FIG. 4.
Figure 4:
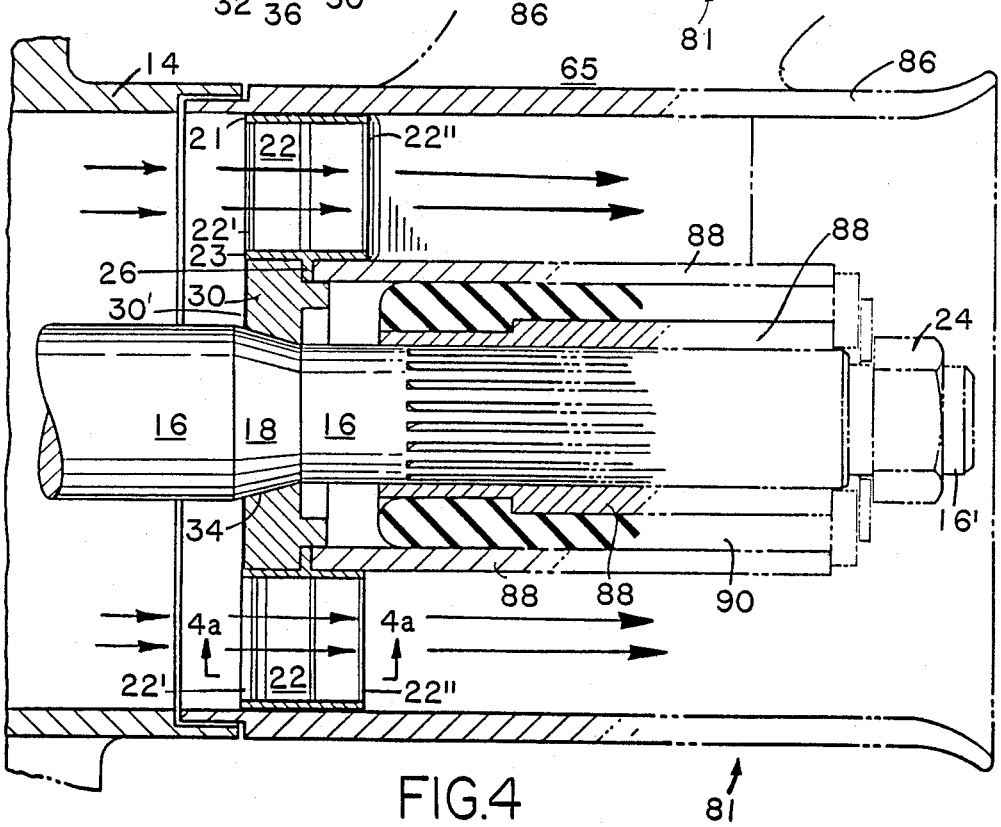
FIG. 4 is a cross sectional view simiar to the view shown in FIG. 2 but without the line cutter means.

In the first embodiment, best seen in FIGS. 4 and 5, impeller hub 20 is rotatably mounted within the exhaust flange end of propeller unit 81 and rearward of the lower drive unit 14 of the marine engine, and is comprised of a cylindrical outer shell member 21 connected in coaxial relation to a smaller diameter cylindrical inner shell member 23 which are connected by a series of air foil-like blade members, referred to collectively as 22. A small internal annular flange 56 mounted midway between the forward and rearward ends of inner cylindrical shell member 23, and on the inner surface thereof, is adapted to engage in abutting relation with an annular relief portion 32 of mounting hub or washer 30, whicy mounting hub 30 is drivingly connected to propeller shaft 16, and may have a tapered inner surface portion 34 (FIG. 4) to mate in press-fit contact relation with tapered surface 18 of propeller shaft 16. The opposite or rearward surface of flange 26 is adpated to engage in abutting non-sliding contact with propeller hub 32, which in turn is overlapped by internal flange 26 in concentric relation. The entire assembly is held together by a nut 24 threaded to threaded end 16' of propeller shaft 16. The entire assembly is adapted to rotate at the same angular velocity as propeller shaft 16. The horizontal arrows shown in FIG. 4 show the direction of the exhaust gas flowing from the forward to the rearward of the engine and propeller hub. The gas flowing therethrough is accelerated across air foil-like vanes 22 when the assembly is rotating, and the exhaust gases are thereby expelled at an increased velocity out the rear of cowling 86 of the propeller unit 81. FIG. 4A shows the cross sectional configuration of one embodiment of an air foil-like vane 22, wherein the flowing gases would move from the forward end of leading edge of air foil 22 to the rearward or trailing edge of air foil 22. In similar fashion to the phenomenon of aerodynamic lift, the area associated with air foil 22, designated as P, realizes an accelerated air flow thereacross which gives rise to a concomitant decrease in pressure. This increase in velocity of the flowing exhaust gases causes a like decrease in the upstream pressure at the exhaust ports of the marine engine, which thereby decreases the exhaust gas pressure being exerted upon the piston during the exhaust stroke.

Air foil impeller 20 may be provided without outer shell member 21 without affecting the operation of the invention. Further modifiction to the instant embodiment may be achieved by simply attaching said series of air foil-like vanes directly to mounting hub or washer 30, or, said series of air foil-like vanes 22 may be connected to a thin, flat, cylindrical ring member (not shown) which may in turn be connected to the forward surface 30' of washer 30.

It should be noted that vanes 22 are preferably airfoils in cross-section, but may be simply impeller blades which push the exhaust gases throught the propeller unit 81 at increased velocity.

As best seen in FIG. 4, the propeller unit 81 may have a hub portion comprised of inner and outer hub portions which is a two-piece generally concentric member having disposed therebetween a rubber or other damping material 90 for damping out vibrations and other unwanted movements such as the shock of the propeller striking an obstruction.

FIG. 3 shows an exploded view of a second embodiment of the invention, namely, where the air foil-like vanes are connected directly to the cutter blade 58 of the line cutter apparatus shown in the above mentioned prior filed U.S. patent application Ser. No. 907,195. That application is incorporated herein by reference as though fully set forth herein. Neither the interconnection nor the functiion of the apparatus therein described is altered by the instant improvement, except that the exhaust gases are expelled from said propeller hub at an elevated velocity, thereby increasing the performance of the marine engine. As seen in FIG. 2, the flow of exhaust gas across vane 22 is accelerated in the direction of the arrows when said propeller and propeller shaft are rotated. Air foil vanes 22 may be extended fowardly of their position shown in FIG. 4, wherein the leading edge 22' may extend well into the inside recess of lower unit 14, and/or rearwardly into propeller unit 81.

In the third embodiment it may be desirable to connect vanes 22 directly to bolt ring 26 and not to rotatable cutter ring 58, wherein vanes 22 may extend forwardly of bolt ring 26 into lower unit 14. Said vanes 22 when connected to bolt ring 26 may also extend rearwardly thereof and may pass through the annular volume defined by the inner and outer portions of cutter ring 58. No interference with the pair of spokes (shown between said inner and outer rings of cutter 58) occurs because said bolt ring 26 rotates at the same angular velocity as cutter ring 58.

FIG. 2A shows a cross sectional configuration of an air foil vane 22 which is preferably used with the above mentioned second or third embodiments, and may also be used with the first embodiment mentioned above.

The embodiment hereabove described are shown in use with a marine outboard or inboard/outboard motor the propeller shaft of which rotates in the clockwise direction when viewed from the rear toward the front of said motor. It is contemplated, however, that the instant invention may also be used with outboard or inboard/outboard motors which rotate counterclockwise when viewed from the rear. In this circumstance, the air foil vanes 22 and propeller blades 65 should be reversed for proper operation of the invention.

In the second embodiment, best seen in FIGS. 2 and 3, the air foil-like vanes are connected to the rotatable cutter ring 58. A non-rotatable cutter ring 36 is sandwiched between first and second bearing means 32 and 50, respectively, which assembly is in turn sandwiched between bolt ring 26 on the forward side thereof and a cutter ring 58 on the rearward side thereof. Said bearing means 32 and 50 allow rotation of said bolt ring 26 and cutter ring 58 with respect to non-rotatable cutter ring 36. Bolt ring 26 and cutter ring 58 are connected to either the propeller hub 88 using any number of locator pins 67, one of which is shown in FIG. 2, or to propeller shaft 16 by either friction fit or pins, bolts or the like.

The elements of this invention can be formed of metal, plastic or reinforced plastic.

The invention has been described herein in what is considered to be the most preferred embodiment. It is considered to be the most preferred embodiment. It is comtemplated that variations may be made without departing from the scope of the invention. Accordingly, the following claims are intended to protect the invention broadly as well as in the specific forms described herein.

What is claimed is:

1. A device for increasing the flow velocity of the exhaust gas issuing from a marine outboard or inboard/-outboard motor having an apparatus that cuts lines, nets, and weeds of the type that may be encountered by propeller driven marine vessels utilizing outboard or inboard/outboard motors, said vessels of the type where the propeller is axially mounted to a rotatable propeller shaft that extends rearwardly from a propeller shaft housing that depends to a vessel's hull, comprising:

a non-rotatably mounted annular cutter ring disposed transversely to said propeller shaft, in encircling relation thereto, a cutting blade member mounted on said cutter ring, a pair of shear edges formed on opposite sides of said cutting blade member;

a protruding forwardly expanding, wedge member formed on said cutting blade member, said wedge member configured to define a forwardly opening wedge-shaped cavity, said wedge-shaped cavity adapted to receive said propeller shaft housing;

a rotatably mounted annular bolt ring disposed intermediate said cutter ring and said propeller shaft housing;

a rotatably mounted annular cutter ring mounted rearwardly of said non-rotatably mounted cutter ring so that said non-rotating cutter ring is disposed in sandwiched relation to said bolt ring and said rotatable cutter ring;

a plurality of circumferentially spaced cutting blade members mounted on said rotatable cutter ring;

a pair of shear edges formed on opposite sides of each of said plurality of cutting blade members;

said protruding wedge member entering into abutting engagement with said propeller shaft housing attendant rotation of said propeller shaft;

said propeller shaft housing entering into fine engagement with said forwardly opening wedge-shaped cavity substantially instantaneously upon the introduction of a load on said apparatus;

a series of impeller blade means connected to said apparatus for increasing the flow velocity of the exhaust gas issuing from said marine motor.

2. The device of claim 1, wherein said serIes of impeller blade means are integrallY connected to said annular bolt ring.

3. The device of claim 1, wherein said series of impeller blade means are integrally connected to said annular cutter ring.

4. The device of claim 1, wherein said apparatus is manufactured from metal.

5. The device of claim 1, wherein said apparatus is manufactured from plastic or reinforced plastic.

* * * * *